US005588760A

United States Patent [19]

So

[11] Patent Number: 5,588,760

[45] Date of Patent: Dec. 31, 1996

[54] KEY SWITCH UNIT FOR COMPUTER KEYBOARDS

[76] Inventor: Henry So, No. 27, Lane 52, Nanking E. Rd., Sec. 4, Taipei, Taiwan

[21] Appl. No.: 583,161

[22] Filed: Jan. 4, 1996

[51] Int. Cl.[6] ..... B41J 5/12

[52] U.S. Cl. ..... 400/495; 400/490; 400/472; 341/22; 345/168

[58] Field of Search ..... 400/495, 472, 400/490, 496; 341/22; 345/168

[56] References Cited

U.S. PATENT DOCUMENTS

| | | | |
|---|---|---|---|
| 3,499,515 | 3/1970 | Mikrut | 341/22 X |
| 4,479,111 | 10/1994 | Madsen et al. | 340/365 |
| 5,456,541 | 10/1995 | Ching-Shui | 400/490 |
| 5,535,091 | 7/1996 | Lee | 361/680 |

*Primary Examiner*—Edgar S. Burr
*Assistant Examiner*—Anthony H. Nguyen
*Attorney, Agent, or Firm*—Beveridge, DeGrandi, Weilacher & Young, L.L.P.

[57] ABSTRACT

A key switch unit including a key holder frame having a plurality of key holders respectively mounted on the rubber cones of a conductive rubber pad above a membrane circuit, one L-shaped key switch and a plurality of elongated key switches and a plurality of square key switches respectively mounted on the key holders and depressed to trigger the membrane circuit to produce a respective electric signal, wherein each key holder has an inside annular flange, a plurality of symmetrical longitudinal grooves on the inside, and a female guide means on the outside; each key switch has a stepped plunger inserted into one key holder, the stepped plunger having longitudinal ribs slidably inserted into the longitudinal grooves of the respective key holder, at least one bottom hook hooked on the inside annular flange of the respective key holder at the bottom, and a step around the periphery, the step being stopped against the inside annular flange of the respective key holder to limit the down stroke of the respective key switch, the L-shaped key switches and the elongated key switches each having at least one one male guide means guided by the female guide means upon down stroke of the respective key switch.

3 Claims, 14 Drawing Sheets

KEY SWITCH UNIT FOR COMPUTER KEYBOARDS

BACKGROUND OF THE INVENTION

The present invention relates to computer keyboards, and relates more particularly to a key switch unit which permits the key switches of different sizes to be arranged at different locations to match with the same design of key holder frame, the same design of conductive rubber pad and the same design of membrane circuit for arranging into any of a variety of keyboard layouts for different purposes.

A regular computer keyboard is generally comprised of a shell, a membrane circuit, a conductive rubber pad supported on the membrane circuit and having a plurality of rubber cones, a key holder frame having a plurality of key holders respectively disposed above the rubber cones, and a set of key switches of different sizes respectively mounted on the key holders of the key holder frame above the rubber cones. The set of key switches include various function control keys of different sizes. When the function control keys are designed to install in different area on the keyboard, the designs of the conductive rubber pad, the membrane circuit, as well as the key holder frame must be relatively changed. Because different conductive rubber pads, membrane circuits and key holder frames must be used for making keyboards of different layouts, the tooling and designing cost is high.

SUMMARY OF THE INVENTION

The present invention has been accomplished under the circumstances in view. It is the principal object of the present invention to provide a key switch unit which can be arranged into any of a variety of forms for assembling different keyboards for different purposes without changing the conductive rubber pad and the membrane circuit. It is another object of the present invention to provide a key switch unit which greatly reduces the manufacturing cost of the computer keyboard.

According to one aspect of the present invention, the key switch unit comprises a membrane circuit having a plurality of electric contacts, a conductive rubber pad mounted on the membrane circuit and having a plurality of rubber cones respectively disposed above the electric contacts, a key holder frame mounted on the conductive rubber pad and having a plurality of key holders respectively disposed above the rubber cones, each key holder defining a longitudinal through hole aligned with one rubber cone, one L-shaped key switch and a plurality of elongated key switches and a plurality of square key switches respectively mounted on the key holders and depressed to trigger a respective electric contact in producing a respective electric signal, wherein each key holder comprises an inside annular flange raised around the periphery of the longitudinal through hole, a plurality of symmetrical longitudinal grooves inside the respective longitudinal through hole for guiding one key switch, a female guide means on the outside for guiding the respective key switch; each key switch comprises a key cap, and a stepped plunger inserted into the longitudinal through hole of one key holder, the L-shaped key switches and the elongated key switches each comprising at least one one male guide means respectively downwardly extending from the respective key cap, each male guide means being guided by the female guide means upon down stroke of the respective key switch, the stepped plunger comprising a thicker upper part, a thinner lower part, a plurality of symmetrical longitudinal ribs raised from the thicker upper part and respectively slidably inserted into the longitudinal grooves of one key holder, and at least one hook raised from the thinner lower part at a bottom side, and a step around the periphery between the thicker upper part and the thinner lower part. According to another aspect of the present invention, each key holder comprises a conical bottom chamber below the respective inside annular flange for receiving one rubber cone. According to still another aspect of the present invention, the step of each plunger is stopped above the inside annular flange of the respective key holder when one key switch is depressed. According to still another aspect of the present invention, the key cap of each key switch has a flat bottom side, the flat bottom side being stopped above the respective key holder to limit the down stroke of the respective key switch when the inside annular flange of the respective key holder is damaged by the stepped plunger of the respective key switch. According to still another aspect of the present invention, each female guide means defines a slot for passing the respective male guide means to above the respective rubber cone.

DETAILED DESCRIPTION OF THE PREFERRED EMBODIMENT

Figure 1:
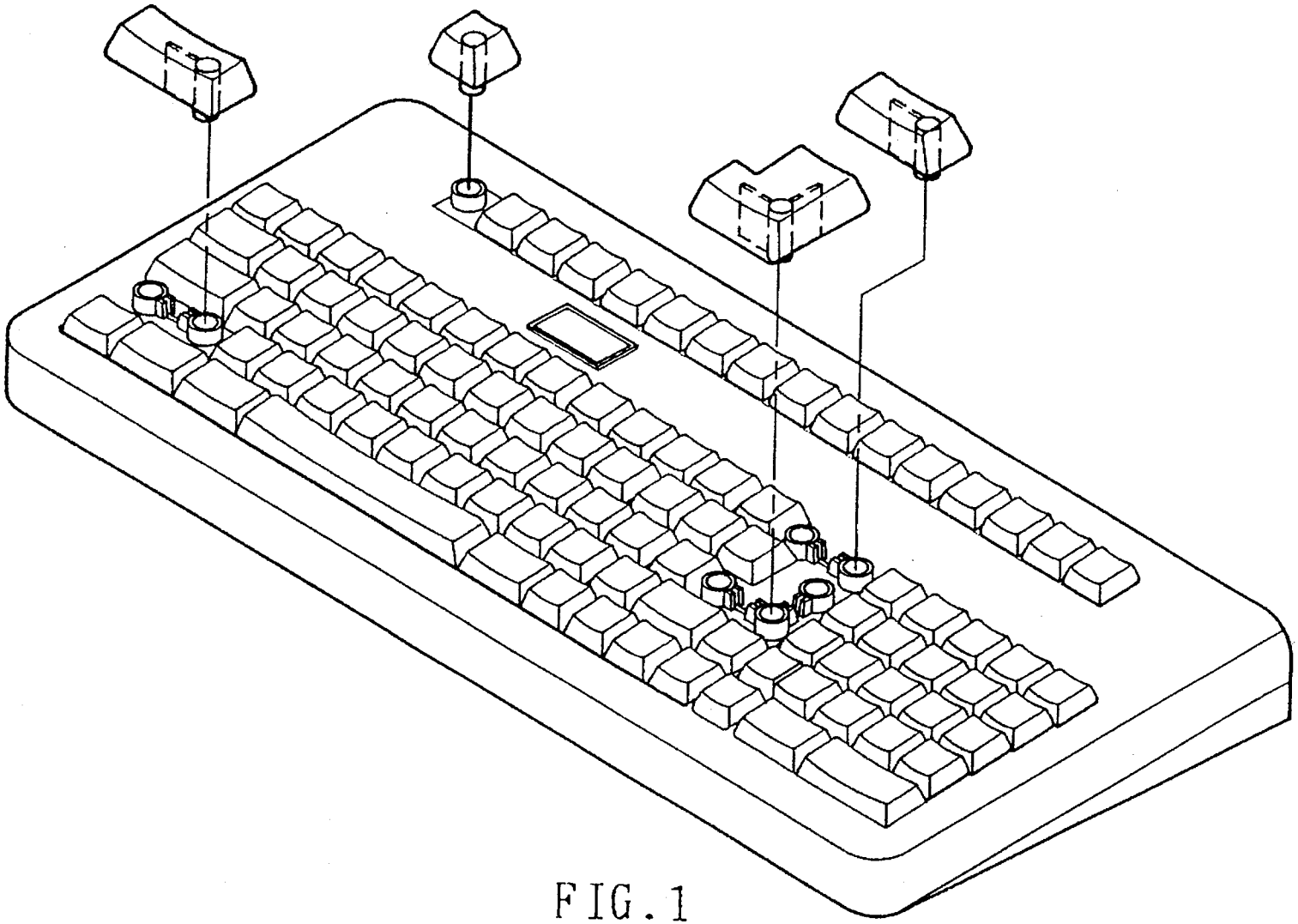
FIG. 1 is an exploded view of a keyboard according to the present invention.
Figure 2:
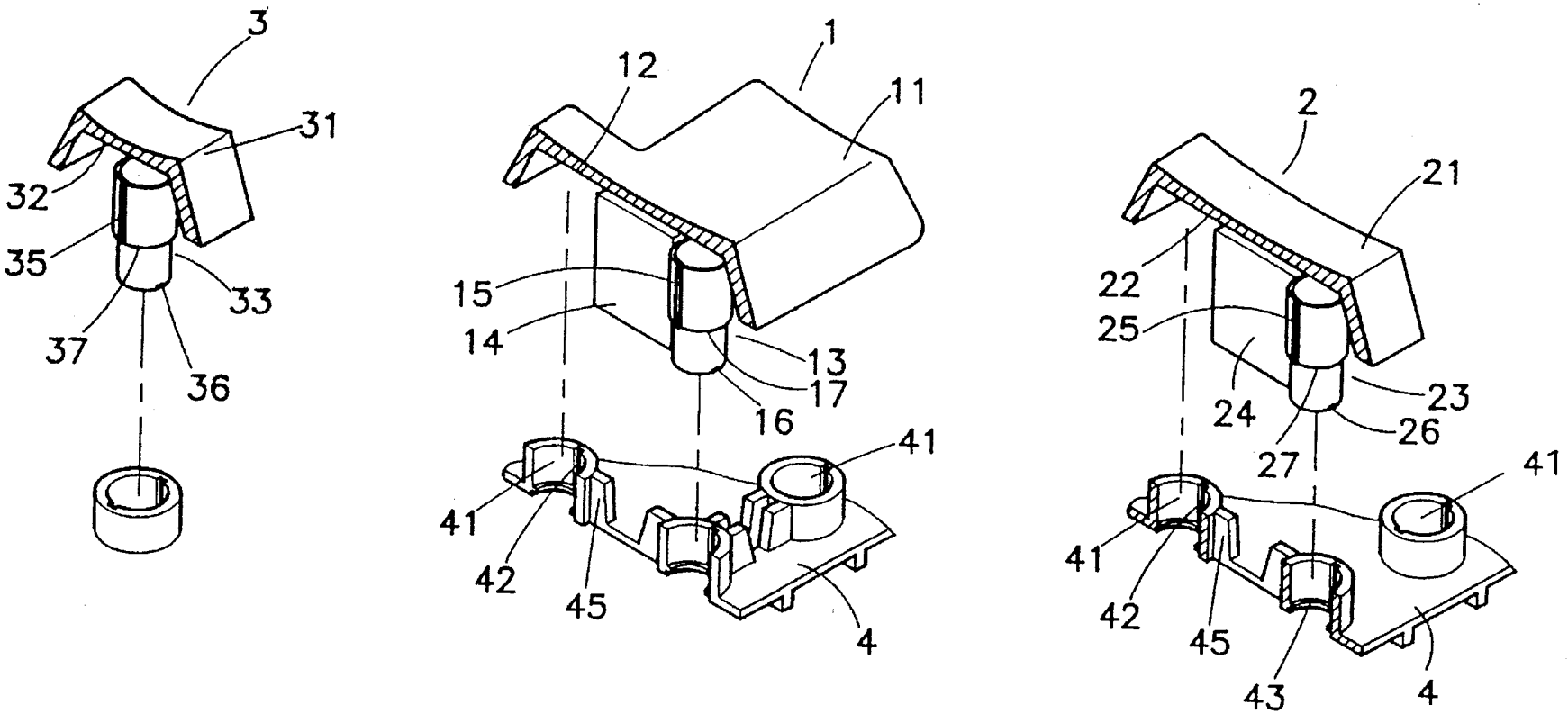
FIG. 2 is an exploded view of a L-shaped key switch, an elongated key switch, and a square key switch according to the present invention.

Referring to FIGS. 1 and 2, the present invention comprises one L-shaped key switch 1 (for example, ENTER key) , a plurality of elongated key switches 2 (for example, CTRL key), a plurality of square (1×1) key switches 3, and a key holder frame 4.

The L-shaped key switch 1 comprises a key cap 11, a stepped plunger 13 and at least one male guide means 14 respectively downwardly extending from the flat bottom side 12 of the key cap 11, wherein the stepped plunger 13 is comprised of a longitudinal rib 15 raised from the thicker upper part thereof, at least one hook 16 at the bottom end of the thinner lower part thereof, and a step 17 around the periphery between the thicker upper part and the thinner lower part.

The elongated key switch 2 comprises a key cap 21, a stepped plunger 23 and at least one male guide means 24 respectively downwardly extending from the flat bottom side 22 of the key cap 21, wherein the stepped plunger 23 is comprised of a longitudinal rib 25 raised from the thicker upper part thereof, at least one hook 26 at the bottom end of the thinner lower part thereof, and a step 27 around the periphery between the thicker upper part and the thinner lower part.

The square key switch 3 comprises a key cap 31, and a stepped long plunger 33 downwardly extending from the flat bottom side 32 of the key cap 31, wherein the stepped plunger 33 is comprised a longitudinal rib 35 raised from the thicker upper part thereof, at least one hook 36 at the bottom end of the thinner lower part thereof, and a step 37 around the periphery between the thicker upper part and the thinner lower part.

The key holder frame 4 comprises a plurality of hollow cylindrical key holders 41 integrally connected in parallel for mounting key switches 1, 2 and 3. Each of the key holders 41 comprises a longitudinal groove 42 on the inside for engagement with the longitudinal rib 15, 25, or 35 of one plunger 13, 23 or 33, an inside annular flange 43 for engagement with the hook 16, 26, or 36 of one plunger 13, 23, or 33, a bottom chamber 44 (see also FIG. 4) for receiving one rubber cone, and at least one female guide means 45 for engagement with the male guide means 14 or 24 of one key switch 1 or 2.

Figure 3:
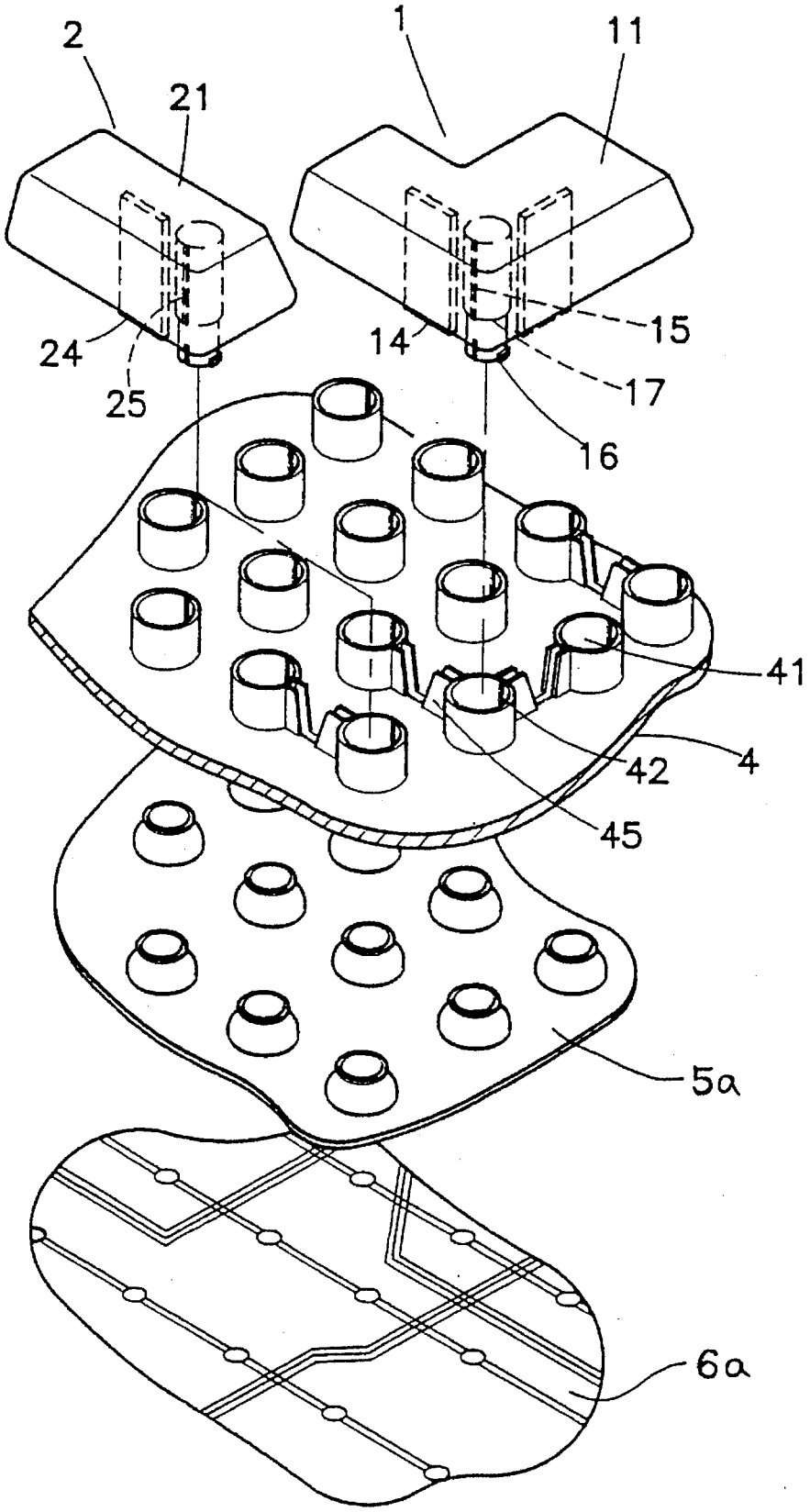
FIG. 3 is an exploded view showing the relative positions of the membrane circuit, the conductive rubber pad, the key holder frame, and the key switches according to the present invention.
Figure 4:
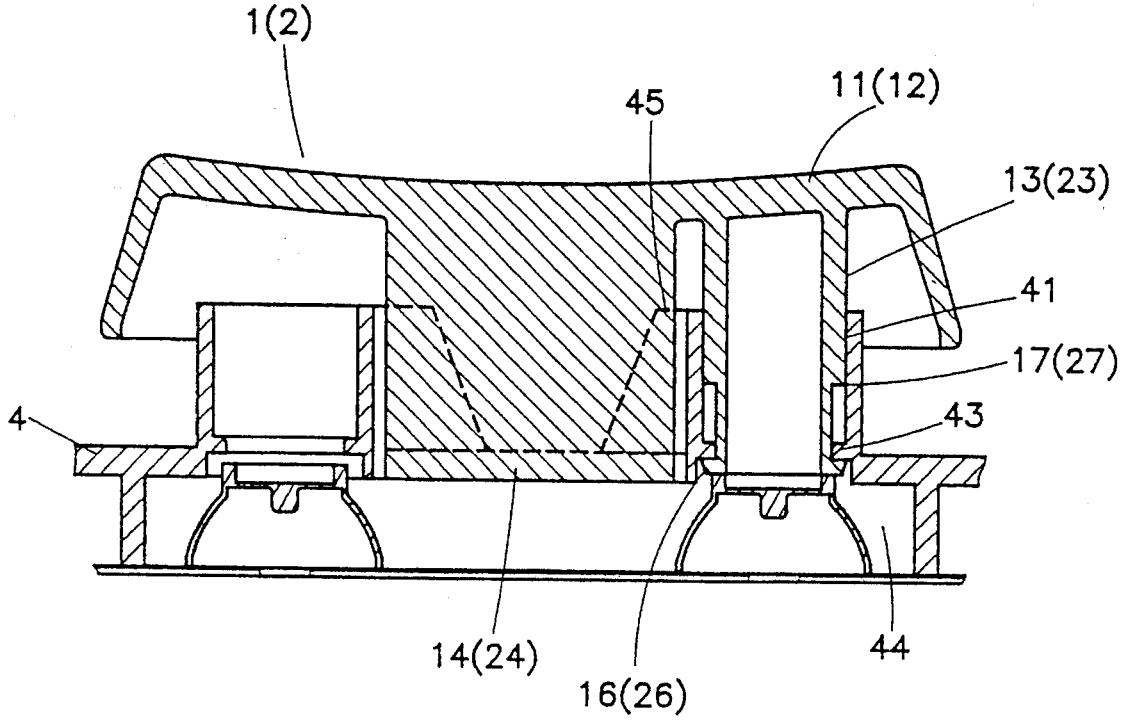
FIG. 4 is a sectional view in an enlarged scale showing an elongated key switch installed according to the present invention.

The installation process of the key switch (for example, one elongated key switch 2) is simple and outlined hereinafter with reference to FIGS. 3 and 4. The stepped plunger 23 of the elongated key switch 2 is inserted into the respective key holder 41 by fitting the longitudinal rib 25 into the longitudinal groove 42 of the respective key holder 41, permitting the hook 26 to hook on the bottom side of the inside annular flange 43 of the respective key holder 41, and permitting the male guide means 24 to be aligned with the female guide means 45 of the respective key holder 41, then the key holder frame 4 is placed on the conductive rubber pad 5*a* above the membrane circuit 6*a*. The installation process of the L-shaped key switch 1 is similar to that of the elongated key switch 2.

Figure 5:
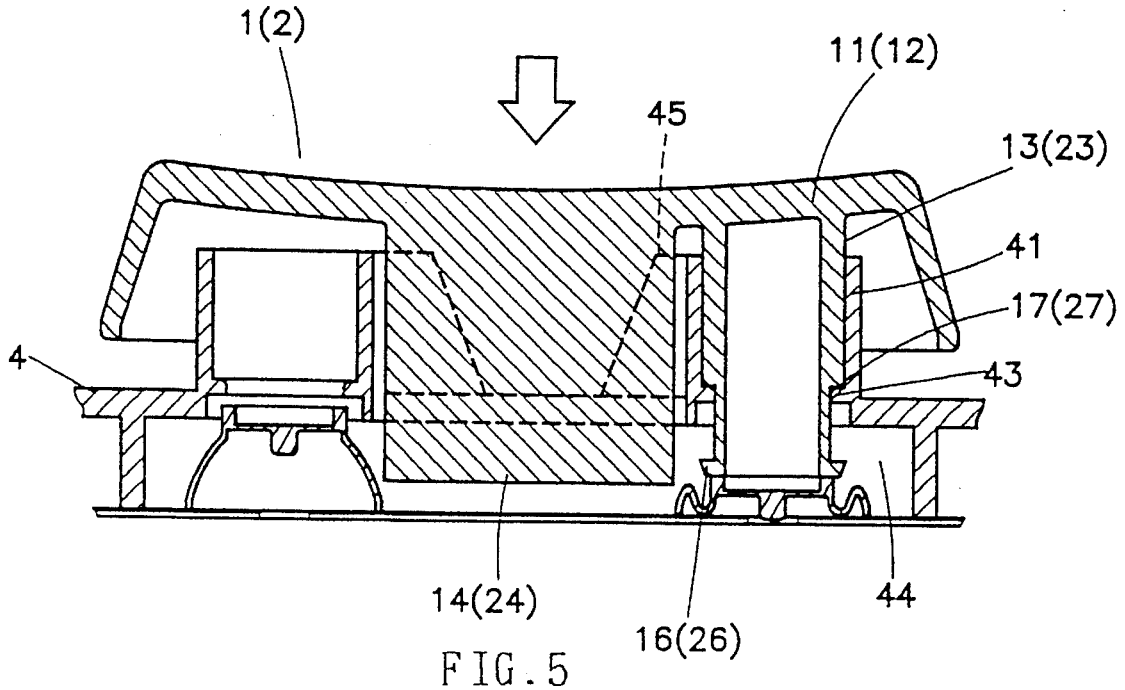
FIG. 5 is similar to FIG. 4 but showing the key switch depressed.
Figure 6:
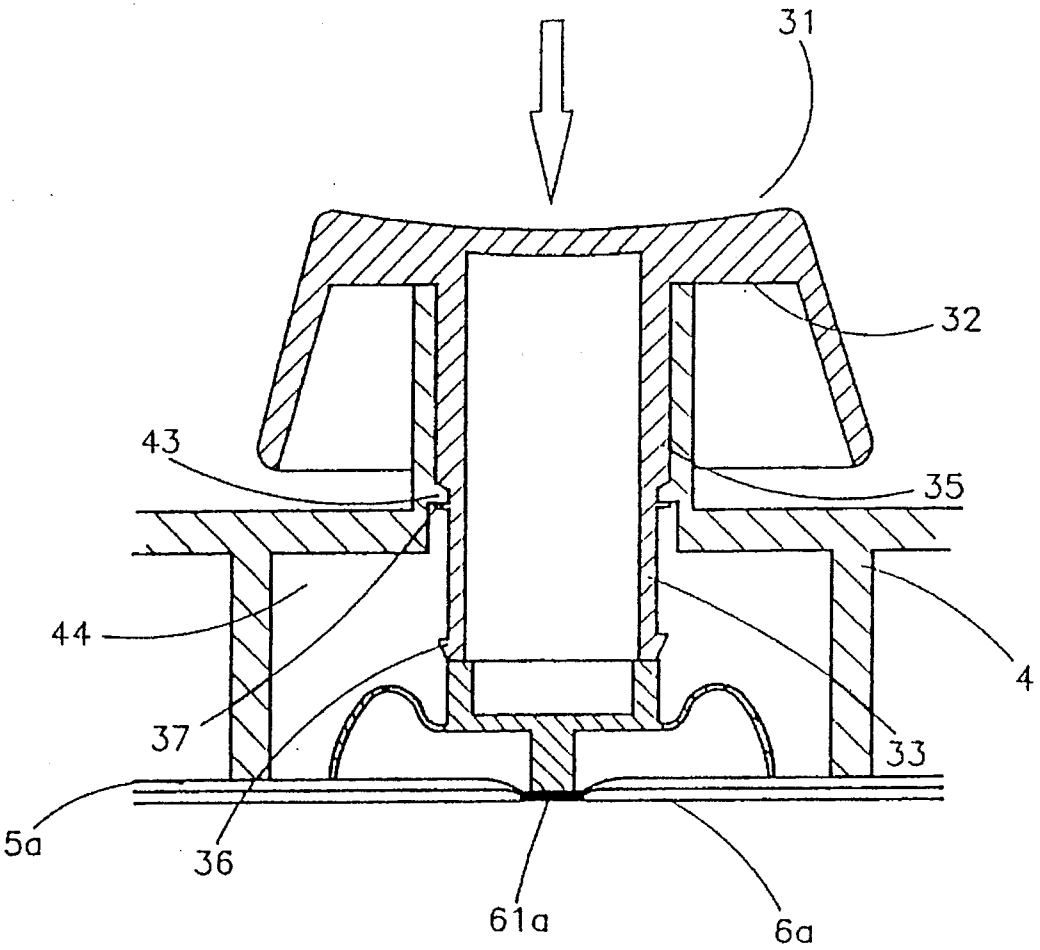
FIG. 6 is an end view of FIG. 5.
Figure 7:
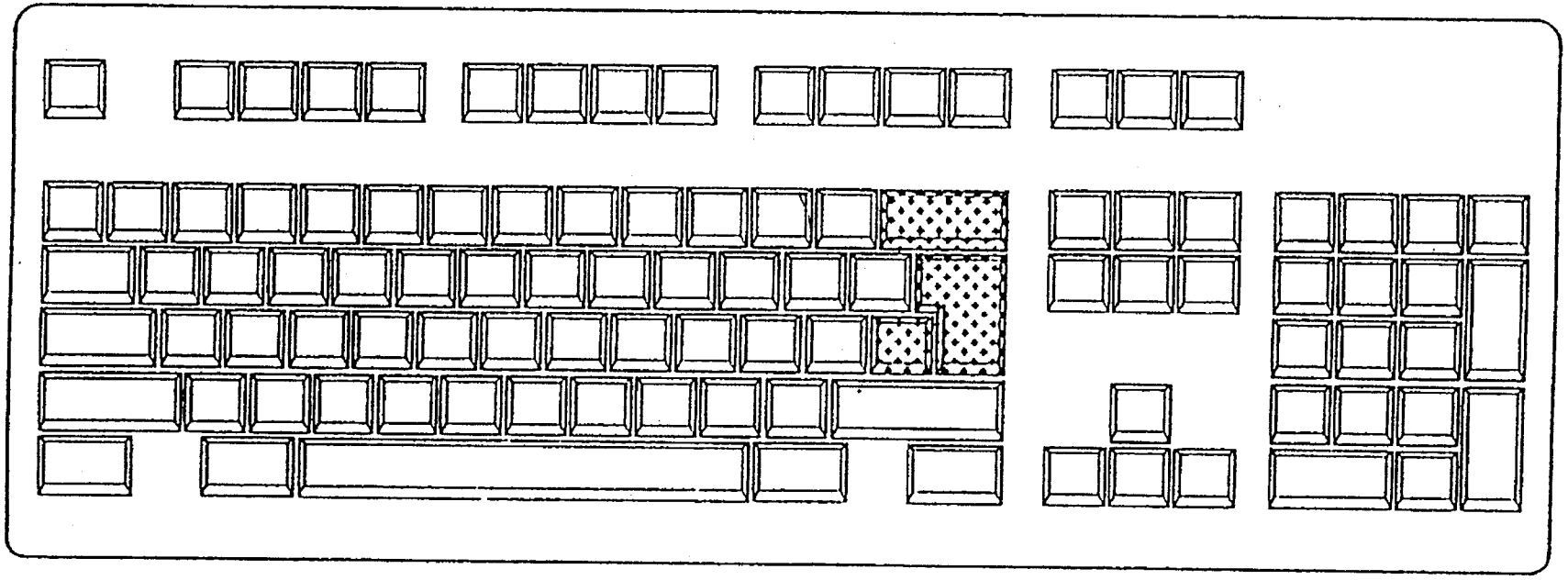
FIG. 7 shows one keyboard layout according to the present invention.
Figure 8:
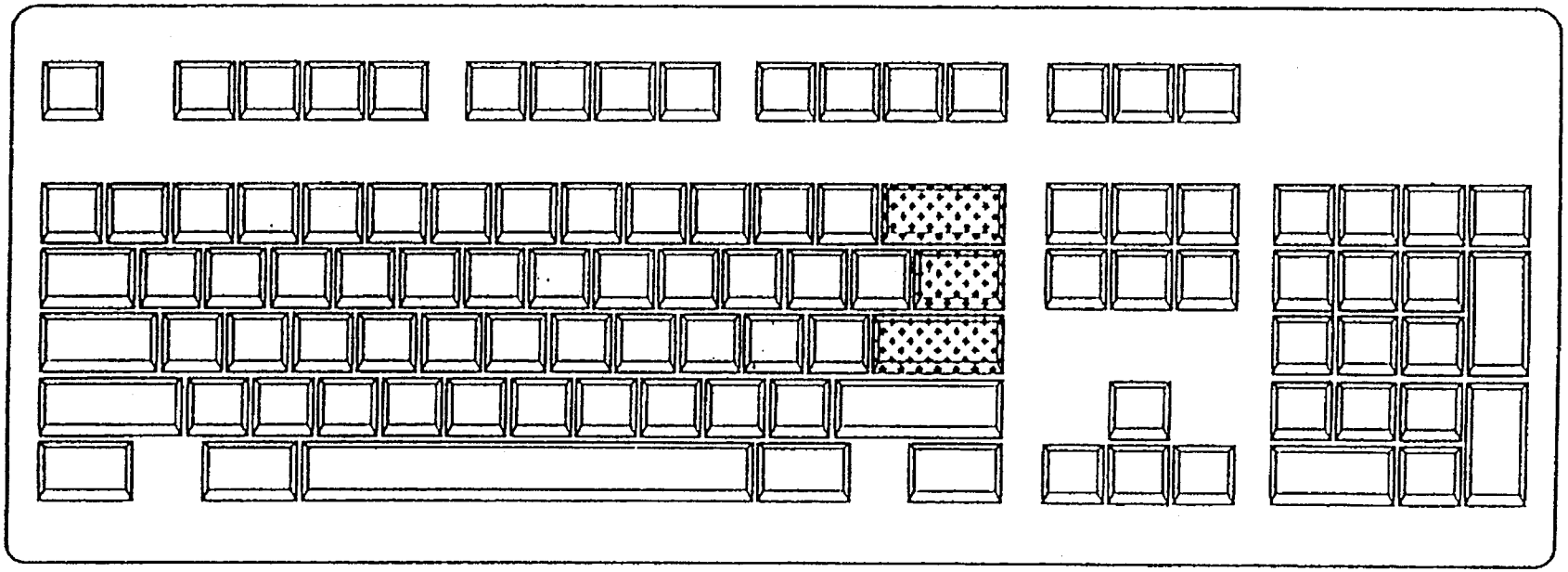
FIG. 8 shows another keyboard layout according to the present invention.
Figure 9:
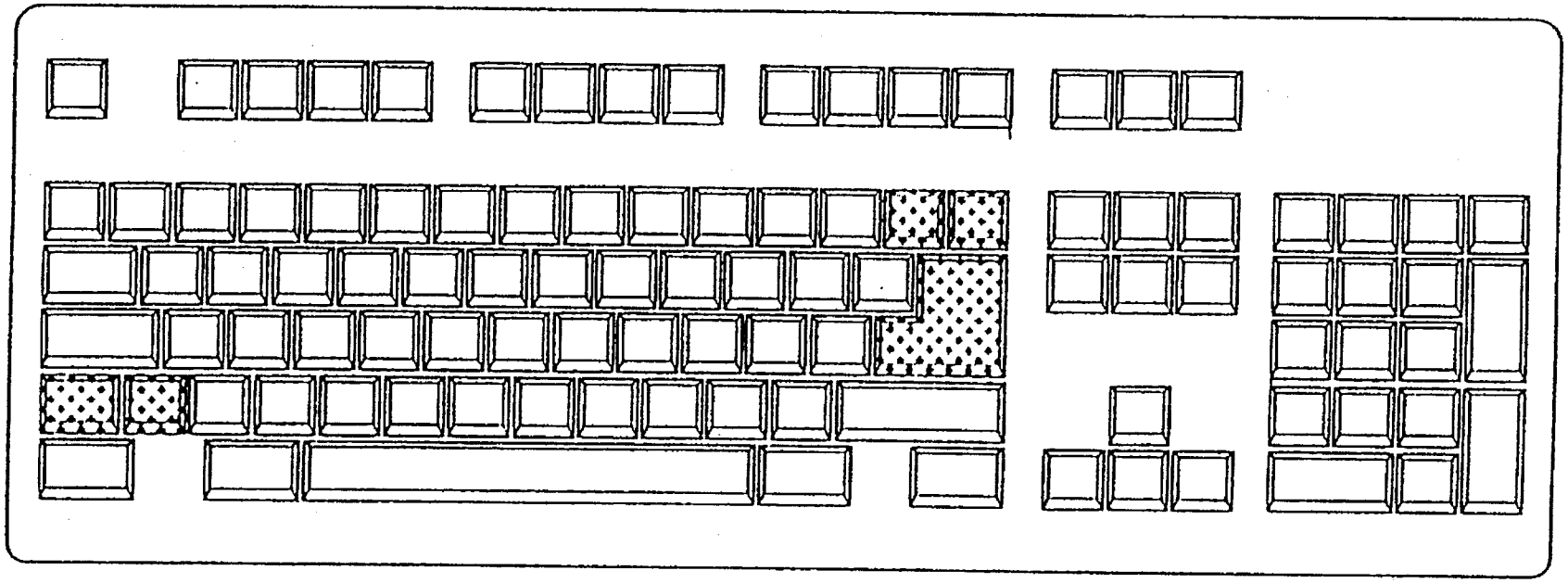
FIG. 9 shows still another keyboard layout according to the present invention.
Figure 10:
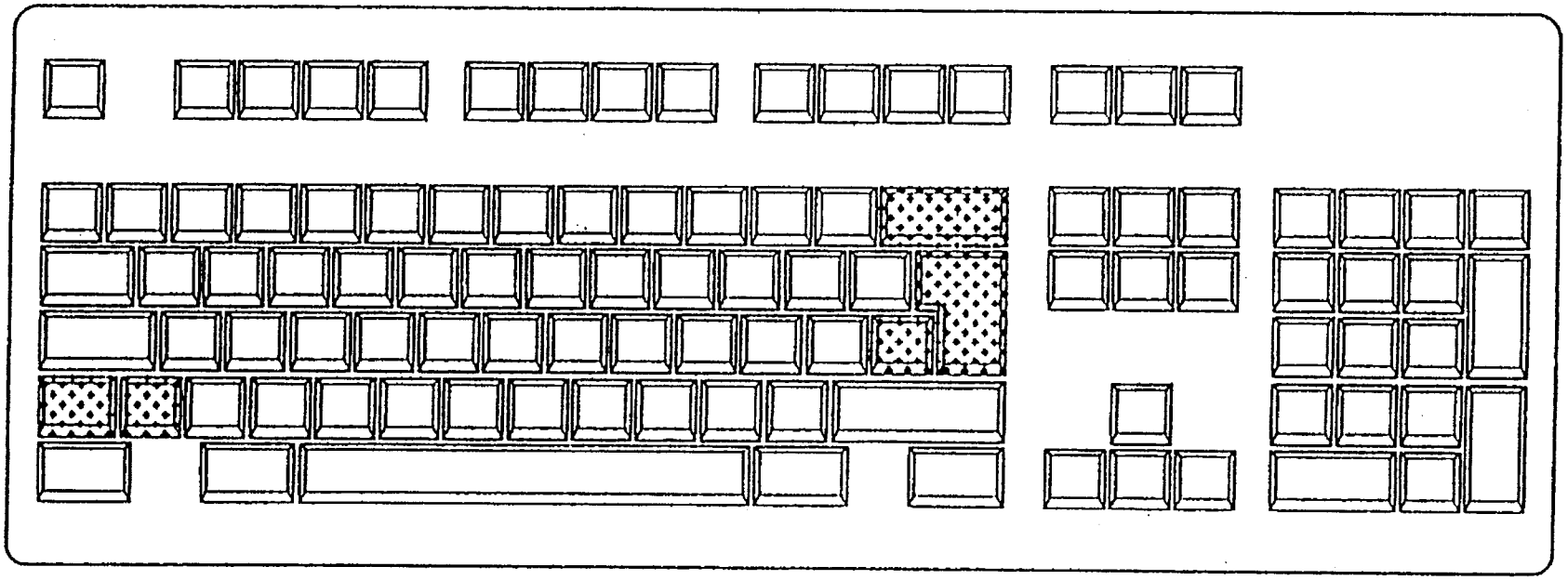
FIG. 10 shows still another keyboard layout according to the present invention.
Figure 11:
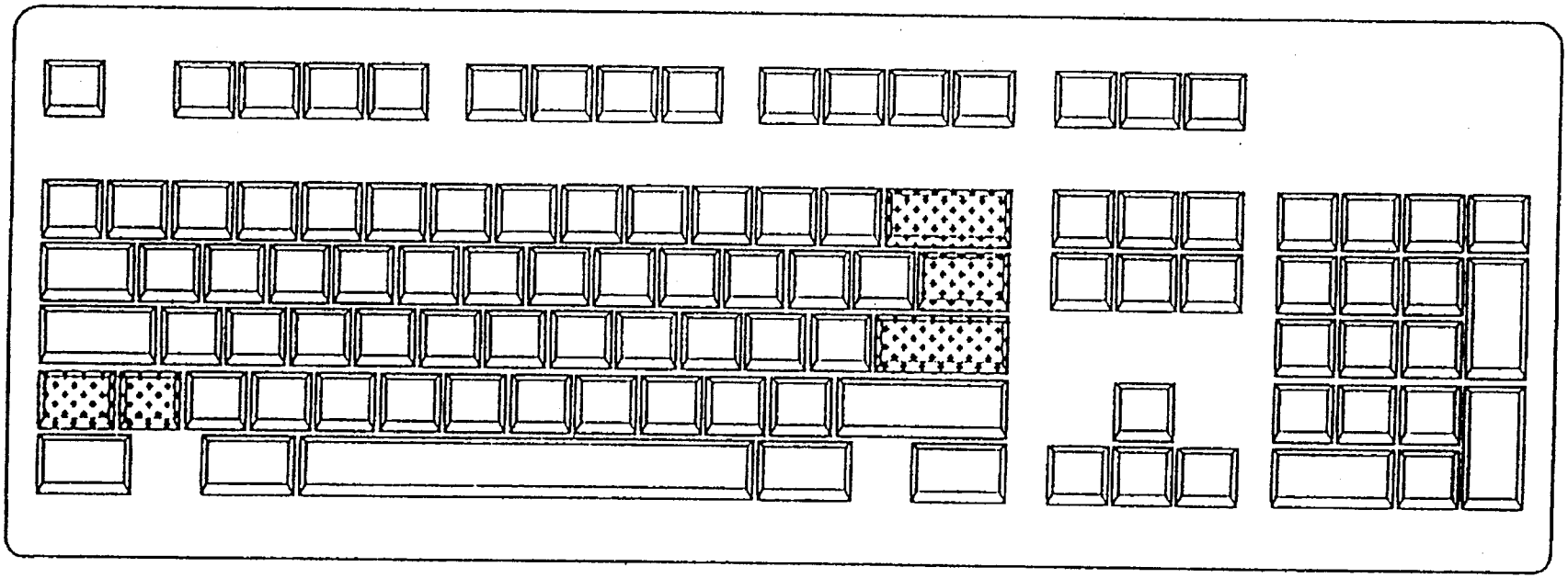
FIG. 11 shows still another keyboard layout according to the present invention.
Figure 12:
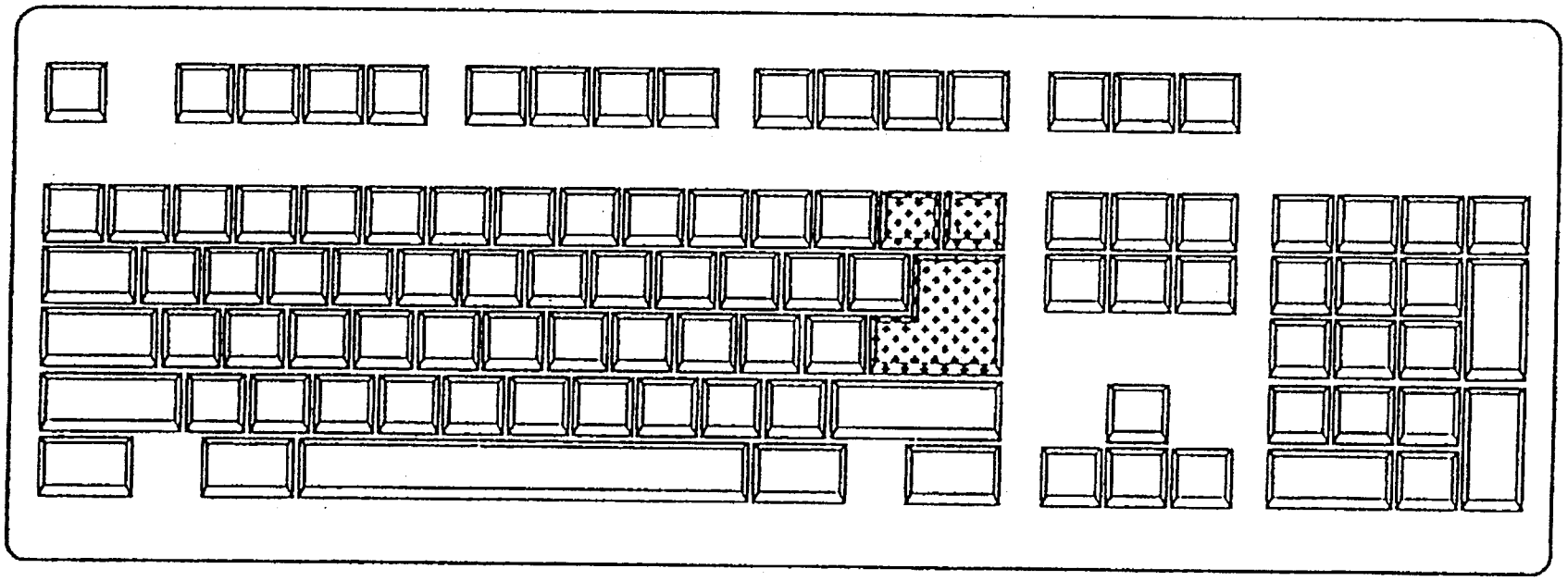
FIG. 12 shows still another keyboard layout according to the present invention.

Referring to FIGS. 5 and 6, when the key switch 2 is depressed to lower the stepped plunger 23 and the male guide means 24, the stepped plunger 23 will be forced to compress the respective rubber cone on the conductive rubber pad 5*a*, causing it to trigger a respective electric contact 61*a* on the membrane circuit 6*a* in producing a respective electric signal, at the same time, the male guide means 24 is forced into the respective female guide means 45 to keep the movement of the key switch 2 in course. During the down stroke of the key switch 2, the step 27 will be stopped at the inside annular flange 42 to limit the downward movement of the stepped plunger 23, and therefore the stepped plunger 23 will not strike the respective rubber cone of the conductive rubber pad 5*a* and the membrane circuit 6*a* excessively. When the key switch 2 is released, the rubber cone immediately returns to its former shape, to move the stepped plunger upwards to its former position.

In case the inside annular flange 43 is damaged by th step 27 of the stepped plunger 23, the down stroke of the stepped plunger 23 will still be limited within a certain range because the flat bottom side 22 of the key cap 21 will be stopped above respective key holder 41 (see FIG. 6). Therefore, the membrane circuit 6*a* will not be damaged by the stepped long plunger 23.

If the L-shaped key switch 1 (ENTER key) is installed in the keyboard to replace three square key switches 3, only the stepped plunger 13 will be forced to compress the respective rubber cone and to trigger the ENTER function control contact on the membrane circuit 6*a* when the L-shaped key switch 1 is depressed, and the other two contacts on the membrane circuit 6*a* corresponding to the male guide means 14 of the L-shaped key switch 1 will not be triggered by the male guide means 14 during the down stroke of the stepped plunger 13 (see FIG. 5).

Figure 13:
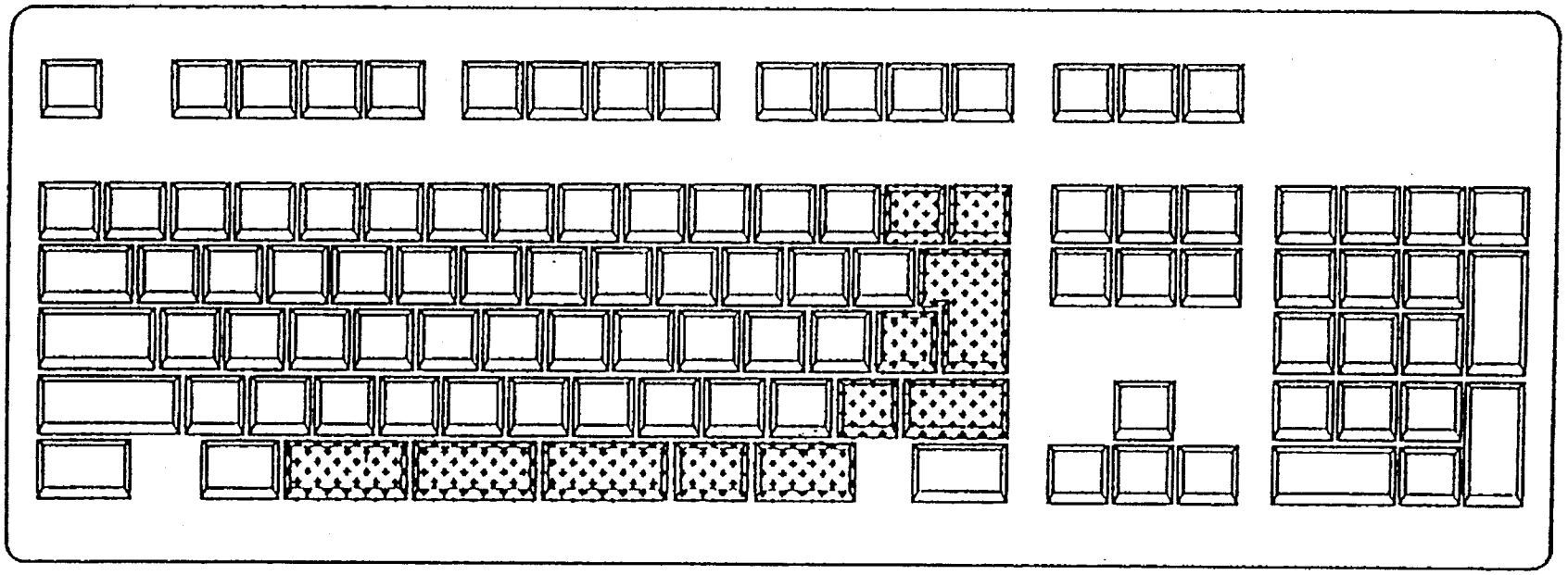
FIG. 13 shows still another keyboard layout according to the present invention.

According to the present invention, the membrane circuit 6*a* and the conductive rubber pad 5*a* can be used to match with the L-shaped key switch 1, the elongated key switches 2, and the square key switches 3 and arranged into any of a variety of forms. For example, using the same membrane circuit 6*a* and the same conductive rubber pad 5*a*, different keyboards are assembled, as shown in FIGS. 7, 8, 9, 10, 11 and 12, by arranging the L-shaped key switch 1, the elongated key switches 2 and the square key switches 3 at different locations. The keyboard shown in FIG. 13 is a DOS/V 106-key Japanese keyboard which also uses the same membrane circuit 6*a* and the same conductive rubber pad 5*a*.

Figure 14:
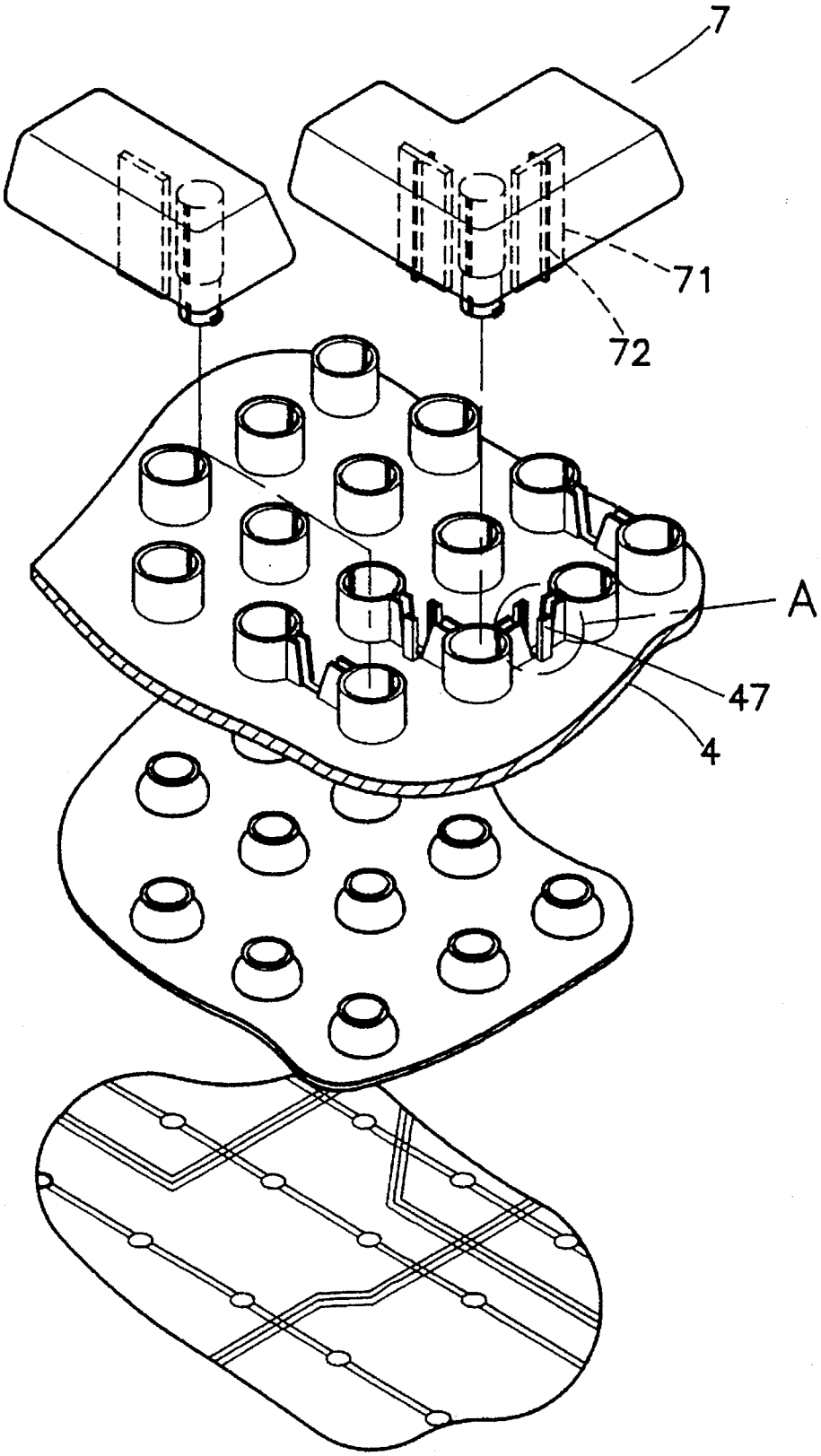
FIG. 14 is an exploded view of an alternate form of the present invention.
Figure 14A:
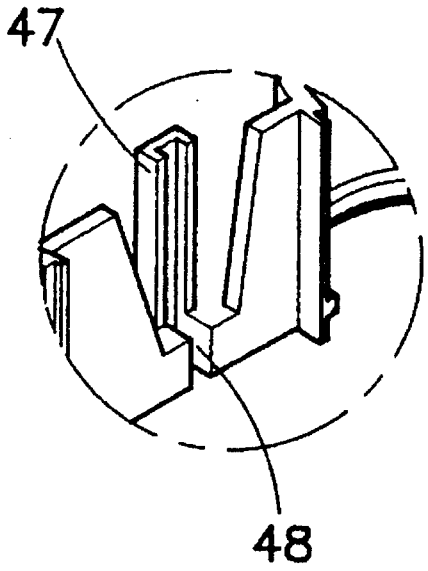
FIG. 14A is an enlarged view of part A of FIG. 14.

FIGS. 14 and 14*a* show an alternate form of the present invention in which the male guide means 71 of the key switch 7 has a longitudinal rib 72 at one side; the female guide means 47 defines a slot 48 in communication with the longitudinal through hole of the respective key holder for passing the respective male guide means 71 to above the respective rubber cone.

It is to be understood that the drawings are designed for purposes of illustration only, and are not intended as a definition of the limits and scope of the invention disclosed.

What is claimed is:

1. A key switch unit for computer keyboards, comprising a membrane circuit having a plurality of electric contacts, a conductive rubber pad mounted on said membrane circuit and having a plurality of rubber cones respectively disposed above said electric contacts, a key holder frame mounted on said conductive rubber pad and having a plurality of key holders respectively disposed above said rubber cones, each key holder defining a longitudinal through hole aligned with one rubber cone, one L-shaped key switch and a plurality of elongated key switches and a plurality of square key switches respectively mounted on said key holders and depressed to trigger a respective electric contact in producing a respective electric signal, wherein each key holder comprises an inside annular flange raised around the periphery of the longitudinal through hole, a plurality of symmetrical longitudinal grooves inside the respective longitudinal through hole for guiding one key switch, a female guide means on the outside for guiding the respective key switch; each key switch comprises a key cap, and a stepped plunger inserted into the longitudinal through hole of one key holder, said L-shaped key switches and said elongated key switches each comprising at least one one male guide means respectively downwardly extending from the respective key cap, each male guide means being guided by said female guide means upon down stroke of the respective key switch, said stepped plunger comprising a thicker upper part, a thinner lower part, a plurality of symmetrical longitudinal ribs raised from said thicker upper part and respectively slidably inserted into the longitudinal grooves of one key holder, and at least one hook raised from said thinner lower part at a bottom side, and a step around the periphery between said thicker upper part and said thinner lower part.

2. The key switch unit of claim 1 wherein each female guide means defines a slot for passing the respective male guide means to above the respective rubber cone.

3. The key switch unit of claim 1 wherein the slot of each female guide means is disposed in communication with the longitudinal through hole of the respective key holder.

* * * * *